US007318456B2

(12) United States Patent
Nayfeh et al.

(10) Patent No.: US 7,318,456 B2
(45) **Date of Patent: *Jan. 15, 2008**

(54) MODULAR WEAVING SYSTEM WITH INDIVIDUAL YARN CONTROL

(75) Inventors: Samir A. Nayfeh, Shrewsbury, MA (US); Jonathan D. Rohrs, Newton Lower Falls, MA (US)

(73) Assignee: Massachusetts Institute of Technology, Cambridge, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/598,347

(22) Filed: Nov. 13, 2006

(65) Prior Publication Data

US 2007/0107796 A1 May 17, 2007

Related U.S. Application Data

(63) Continuation-in-part of application No. 11/113,510, filed on Apr. 25, 2005, now Pat. No. 7,178,558.

(60) Provisional application No. 60/736,808, filed on Nov. 14, 2005.

(51) Int. Cl.

| | |
|---|---|
| ***D03D 49/00*** | (2006.01) |
| ***D03D 49/02*** | (2006.01) |
| ***D03D 49/60*** | (2006.01) |
| *D03D 51/02* | (2006.01) |
| *D03D 41/00* | (2006.01) |

(52) U.S. Cl. ..... 139/11; 139/1 E; 139/56; 139/349

(58) Field of Classification Search ..... 139/1 E, 139/11, 24, 35, 56, 66 A, 99, 449, 224 R, 139/349

See application file for complete search history.

(56) References Cited

U.S. PATENT DOCUMENTS

| | | | | |
|---|---|---|---|---|
| 2,564,677 | A | | 2/1951 | Kane |
| 2,862,525 | A | | 12/1958 | Ginley |
| 3,224,465 | A | | 12/1965 | Fontaine |
| 3,308,854 | A | | 3/1967 | Pfarrwaller |
| 3,432,117 | A | * | 3/1969 | Leger ..... 242/131 |
| 3,432,118 | A | * | 3/1969 | Carruthers ..... 242/131.1 |
| 4,105,052 | A | * | 8/1978 | Trost et al. ..... 139/101 |
| 4,170,249 | A | * | 10/1979 | Trost ..... 139/11 |
| 4,342,339 | A | | 8/1982 | Koch |

(Continued)

OTHER PUBLICATIONS

Lord, P.R. and M.H. Mohamed, Weaving: Conversion of Yarn to Fabric, 2nd ed. Shildon, England: Merrow Publishing, 1982. (pp. 289-324).

*Primary Examiner*—Gary L. Welch
*Assistant Examiner*—Robert H Muromoto, Jr.
(74) *Attorney, Agent, or Firm*—Sampson & Associates, P.C.

(57) ABSTRACT

A modular weaving machine includes a loom chassis and a plurality of modular warp units. The warp units are each configured for supporting a plurality of removable bobbins thereon, the bobbins being pre-loadable with a plurality of warp threads. The loom chassis is configured to receivably support the warp units thereon, so that the warp threads are disposed in parallel, spaced relation to one another, extending in a downstream direction. A plurality of shedding actuators are coupled to the loom chassis and configured to form a shed with warp threads of each of the warp units. A weft insertion module is configured to insert a weft thread through the shed.

38 Claims, 10 Drawing Sheets

U.S. PATENT DOCUMENTS 4,760,628 A 8/1988 Kaufmann et al.
4,850,399 A * 7/1989 Linka et al. ..... 139/436
4,887,650 A 12/1989 McGinley
4,972,562 A 11/1990 Tanaka et al.
5,174,000 A * 12/1992 Wilhelm et al. ..... 28/205
5,200,904 A * 4/1993 Tottman ..... 700/131
5,253,404 A * 10/1993 Weber et al. ..... 28/204
5,274,894 A * 1/1994 Wilhelm et al. ..... 28/202
5,355,566 A * 10/1994 Eglseer et al. ..... 28/202
5,371,930 A 12/1994 Lindenmueller et al.
5,381,594 A * 1/1995 Piccirillo et al. ..... 28/208
5,475,906 A * 12/1995 Magdika ..... 28/205
5,505,231 A * 4/1996 Bassing ..... 139/188 R
5,518,038 A * 5/1996 Steiner ..... 139/28
5,645,111 A * 7/1997 Lindblom ..... 139/55.1
5,657,796 A * 8/1997 Steiner ..... 139/28
5,775,380 A 7/1998 Roelstraete et al.
6,000,439 A 12/1999 Speich
6,135,163 A * 10/2000 Wahhoud et al. ..... 139/114
6,249,939 B1 6/2001 Kremer
6,314,628 B1 11/2001 Crook
6,397,443 B1 * 6/2002 Good et al. ..... 28/206
6,494,235 B1 12/2002 Bruyere et al.
6,892,766 B2 * 5/2005 Bryn et al. ..... 139/11
2005/0016611 A1 1/2005 Casrotto
2005/0103394 A1 5/2005 Bassi et al.
2005/0166989 A1 8/2005 Debaes et al.

* cited by examiner

MODULAR WEAVING SYSTEM WITH INDIVIDUAL YARN CONTROL

RELATED APPLICATIONS

This application claims priority, and is a Continuation-In-Part of U.S. patent application Ser. No. 11/113,510, entitled Modular Weaving for Short Production Runs, filed on Apr. 25, 2005 now U.S. Pat. No. 7,178,558, the contents of which are incorporated herein by reference in their entirety for all purposes.

This application claims the benefit of U.S. Provisional Application Ser. No. 60/736,808, entitled Warp Unit Apparatus and Method for Modular Weaving for Short Production Runs, filed on Nov. 14, 2005, the contents of which are incorporated herein by reference in their entirety for all purposes.

BACKGROUND

1. Technical Field

This invention relates to weaving equipment, and more particularly to a modular warp unit for use in weaving short production runs.

2. Background Information

Throughout this application, various publications, patents and published patent applications are referred to by an identifying citation. The disclosures of the publications, patents and published patent applications referenced in this application are hereby incorporated by reference into the present disclosure.

A wide variety of disparate weaving apparatuses have been used in the textile industry. Modern textile factories utilize sophisticated technology to automate many aspects of the weaving process. Such automation has had the effect of greatly reducing many of the costs associated with finished fabric. However, the weaving process typically relies on relatively complex set-up procedures, in which the warp threads to be woven into the finished bolt of fabric must be wound onto a beam, and individually drawn through heddles and a reed(s) prior to commencement of weaving operations. Although this process is typically automated to some extent, it must generally be completed before weaving is commenced, i.e., prior to weaving each bolt of fabric.

The nature of these set-up operations provides a number of burdens on the textile manufacturer. Firstly, both the looms and the set-up equipment (creel, beaming machines, drawing machines) represent a substantial monetary investment. As such, it is desirable to operate them with as little downtime as possible, in order maximize the return on this capital investment. This effectively bars the dedicated use of particular set-up equipment for a particular loom, instead requiring the use of the set-up equipment to be shared among several looms. This complicates the task of scheduling the preparation and weaving operations, and in particular it increases the chances that the weaving of some particular fabric will be delayed because set-up equipment is occupied in preparing for some other piece of fabric.

Secondly, the physical movement of the warp threads in various stages of preparation (spools, beam, drawn-in beam) from one dedicated piece of equipment to another, and the warp threads' installation and removal from said equipment, are operations that are time-consuming and have been automated to a markedly more-limited extent. This aspect provides a strong incentive for loom operators to wind the beam with ever-longer warp threads, often of thousands of meters in length, to minimize the number of these secondary set-up operations that must be executed per unit of fabric woven. However, use of such long warp threads may complicate set-up, and generally militates against relatively short production runs. Furthermore, it decreases the ability of the textile manufacturer to adjust production according to new information about product demand, flaws in raw materials, or errors in weave preparation that may be available only after weaving has commenced.

Accordingly, a need exists for a loom that may be quickly and easily set-up to utilize relatively short warp threads, e.g., to facilitate short production runs with short lead-time. It is also desirable to enable the use of such short warp threads without limiting the overall length of the bolt of fabric produced thereby.

SUMMARY

In one aspect of the invention, a modular weaving machine includes a loom chassis and a plurality of modular warp units. The warp units are each configured for supporting a plurality of removable bobbins thereon, the bobbins being pre-loadable with a plurality of warp threads. The loom chassis is configured to receivably support the warp units thereon, so that the warp threads are disposed in parallel, spaced relation to one another, extending in a downstream direction. A plurality of shedding actuators are coupled to the loom chassis and configured to form a shed with warp threads of each of the warp units. A weft insertion module is configured to insert a weft thread through the shed.

In another aspect of the invention, a modular weaving machine includes a loom chassis and a plurality of modular warp units. The warp units are each configured for supporting a plurality of warp threads. The warp units also releasably support a plurality of quick-release heddles configured for respectively receiving the warp threads therein. The loom chassis is configured to receivably support the warp units therein, so that the warp threads of the warp units each extend in a downstream direction from the beams in parallel, spaced relation to one another. A plurality of heddle actuators are coupled to the loom chassis, and configured to selectively actuate the heddles of each of the warp units to effect collective shedding of the warp threads. A weft insertion module configured to insert a weft thread among the warp threads during the collective shedding.

In yet another aspect of the invention, a modular weaving machine includes a loom chassis and a plurality of modular warp units. The warp units are each configured for being pre-loaded with a plurality of warp threads. The warp units removably support a reed bracket configured to removably support individual reed blades thereon. The loom chassis is configured to receivably support the warp units therein, so that the warp threads of the warp units each extend in a downstream direction from the beams in parallel, spaced relation to one another. A plurality of heddle actuators are coupled to the loom chassis, and configured to selectively actuate the heddles of each of the warp units to effect collective shedding of the warp threads. A weft insertion module configured to insert a weft thread among the warp threads during the collective shedding.

In a still further aspect of the invention, a modular warp unit for use in a modular weaving machine includes a body configured for being received within a loom chassis. The body supports a plurality of removable bobbins pre-loadable with a plurality of warp threads. The warp threads are supported in parallel, spaced relation to one another, extending from the bobbins in a downstream direction through a plurality of quick-release heddles releasably supported by said body. The heddles are engagable by a plurality of shedding actuators coupled to the loom chassis, to form a shed with said warp threads through which a weft insertion module associated with the loom chassis is configured to insert weft thread. A modular reed releasably supported by the body includes a plurality of detachable blades configured for being interspersed among said warp threads. The modular reed assembly is engagable by an actuating sley disposed on the loom chassis.

In a further aspect of the invention, a method of weaving includes pre-winding a plurality of warp threads onto a plurality of bobbins, and loading a plurality of the bobbins onto a plurality of modular warp units so that the warp threads extend in parallel, spaced relation, in a downstream direction from the bobbins. The method also includes placing the warp units onto a loom chassis configured to receivably support the warp units therein, so that the warp threads of each of the warp units are disposed in parallel, spaced relation to one another. A shedding actuator coupled to the loom chassis is used to form a shed of the warp threads. A weft insertion module coupled to the loom chassis is used to insert a weft thread through the shed as it is formed, while others of the bobbins are pre-wound and loaded into other modular warp units.

In a still further aspect of the invention, a method of weaving includes loading a plurality of quick-release heddles threaded with warp threads extending therethrough, onto a plurality of modular warp units, so that the warp threads extend in parallel, spaced relation thereon. The warp units are placed onto a loom chassis so that the warp threads of each of the warp units are disposed in parallel, spaced relation to one another. A shed of warp threads is formed with a shedding actuator coupled to the loom chassis. Weft thread is inserted through the shed with a weft insertion module coupled to the loom chassis. During the shedding and inserting of weft thread, warp threads are loaded into other modular warp units.

In yet another aspect of the invention, a method of weaving includes loading a plurality of warp threads onto a plurality of modular warp units, so that the warp threads extend in parallel, spaced relation through a reed housing disposed thereon. Reed blades are interspersed among the warp threads within the reed housing to form a plurality of reed dents. The warp units are placed onto a loom chassis so that the warp threads of each of the warp units are disposed in parallel, spaced relation to one another. A shed of warp threads is formed with a shedding actuator coupled to the loom chassis. Weft thread is inserted through the shed with a weft insertion module coupled to the loom chassis. During the shedding and weft insertion, a plurality of warp threads may be loaded into other modular warp units.

BRIEF DESCRIPTION OF THE DRAWINGS

The above and other features and advantages of this invention will be more readily apparent from a reading of the following detailed description of various aspects of the invention taken in conjunction with the accompanying drawings, in which.

DETAILED DESCRIPTION

Figure 1:
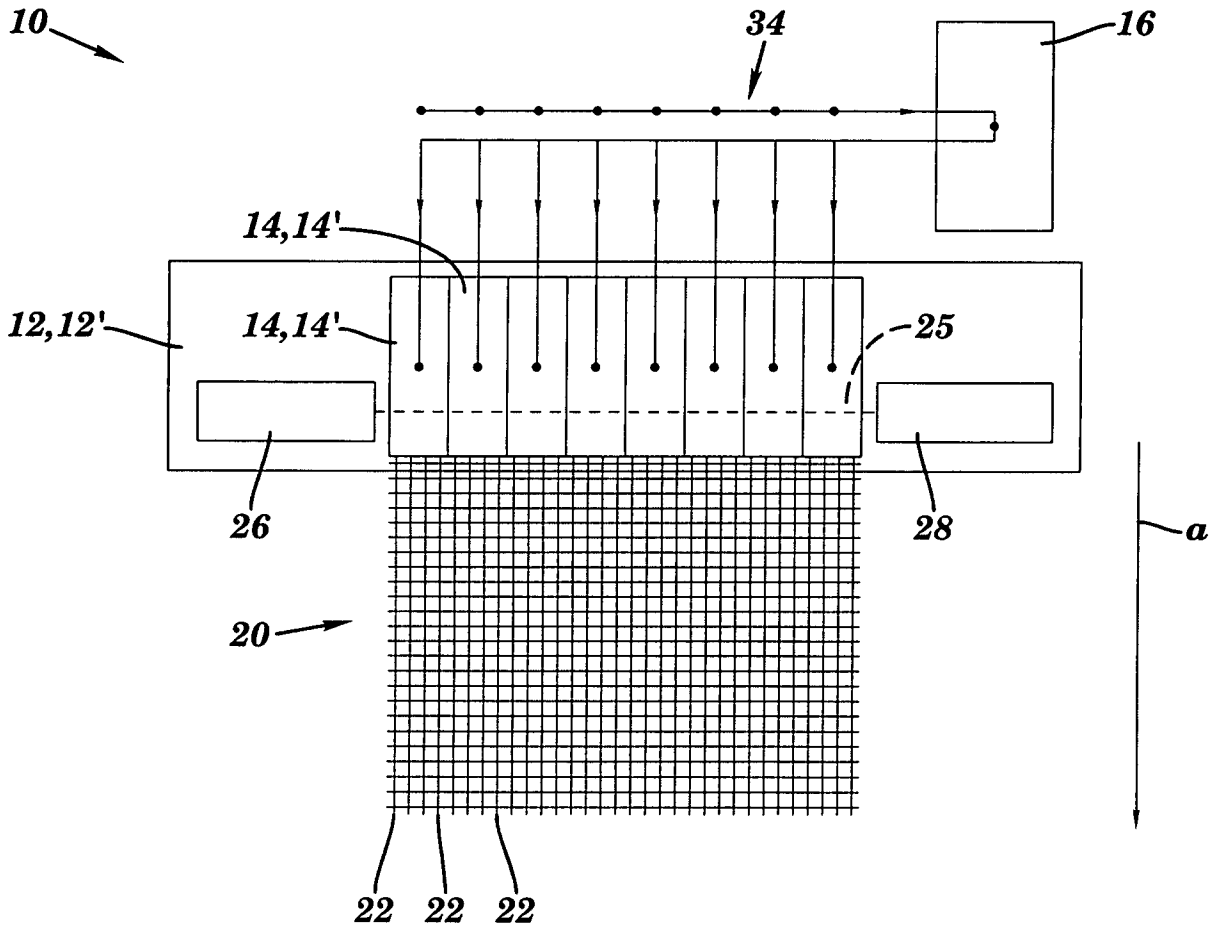
FIG. 1 is a schematic plan view of an embodiment of a weaving system of the present invention in batch mode operation.
Figure 2:
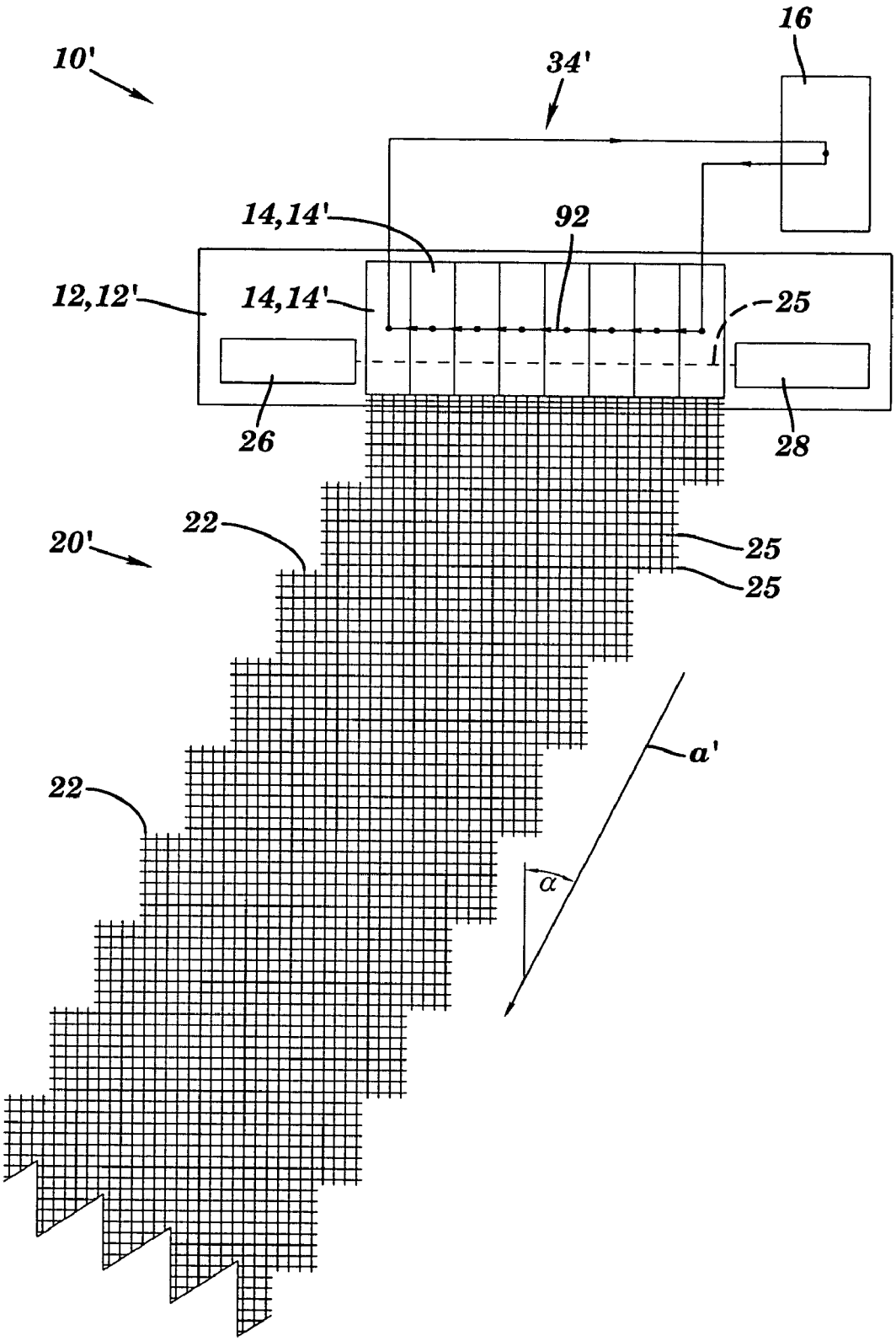
FIG. 2 is a view similar to that of FIG. 1, of the weaving system in continuous mode operation.

In the following detailed description, reference is made to the accompanying drawings that form a part hereof, and in which is shown by way of illustration, specific embodiments in which the invention may be practiced. These embodiments are described in sufficient detail to enable those skilled in the art to practice the invention, and it is to be understood that other embodiments may be utilized. It is also to be understood that structural, procedural and system changes may be made without departing from the spirit and scope of the present invention. The following detailed description is, therefore, not to be taken in a limiting sense, and the scope of the present invention is defined by the appended claims and their equivalents. For clarity of exposition, like features shown in the accompanying drawings shall be indicated with like reference numerals and similar features as shown in alternate embodiments in the drawings shall be indicated with similar reference numerals.

Where used in this disclosure, the term "downstream" when used in connection with an element described herein, refers to a direction relative to the element, which, when installed onto loom chassis 12, 12', is substantially parallel to the direction with which warp threads 22 are payed-out as they are woven, as shown in FIGS. 1 and 2. The term "upstream" refers to a direction opposite the downstream direction. The terms "transverse" and "lateral" refer to directions other than substantially parallel to the upstream and downstream directions.

Overview

Referring to FIGS. 1 and 2, embodiments of the present invention include a modular weaving machine 10, 10' having at least two major modules: a loom chassis 12, 12' and a series of warp units 14. An optional third module, is referred to as warp loader 16. This modularity provides these embodiments with versatility to operate in batch or continuous modes. In continuous mode, warp threads may be shorter in length than that of the finished fabric.

The loom chassis 12, 12' and the warp units 14, together, may be used to weave fabric 20, 20'. Each warp unit 14 performs warp-handling functions required for weaving a relatively narrow strip portion of fabric 20, 20', including shedding and storage of a predetermined number of warp threads 22 associated with the strip. Each warp unit 14 also includes a reed portion 24 (FIG. 3) for beating-up that strip of fabric.

The loom chassis 12, 12' provides for the handling of weft (e.g., fill) thread 25, including the insertion and storage of unwoven weft thread, using weft insertion modules 26, 28 disposed on opposite sides of the array of warp units 14 as shown. Loom chassis 12, 12' also provides take-up motion for the woven fabric 20, 20', actuation of various components of warp-units 14, and includes provisions for receiving and optionally laterally moving the warp units 14.

During weaving operation, one or more warp units 14 may be installed into loom chassis 12, 12' using a transport device 34, 34' associated with warp loader 16. At each warp unit 14, the combination of its warp threads 22 and weft threads from the weft insertion modules 26, 28, produces a woven strip portion of fabric which is approximately the same width as the warp unit itself. Two or more warp units 14 may be positioned adjacent to one another as shown, so that the strip portions are merged to form a proportionally wider fabric 20, 20' as shown. Advantageously, there are no seams in the fabric between adjacent strip portions, since the weft thread 25 runs continuously across all warp units 14, and the warp threads 22 from all of the warp units are spaced substantially evenly relative to one another.

In the embodiment of FIG. 2, warp units 14 are cycled laterally respectively into and out of an ongoing weaving operation. This action advantageously enables production of a fabric 20' of effectively infinite length, using short warp threads 22. This provides fabric 20' with a longitudinal axis a' disposed at an oblique angle $\alpha$ to warp threads 22. In addition, warp units 14 may be loaded off-line and then cycled into the ongoing weaving operation, to effectively permit weaving to be effected continuously, with no downtime for 'drawing-in' warp threads, etc.

Figure 3:
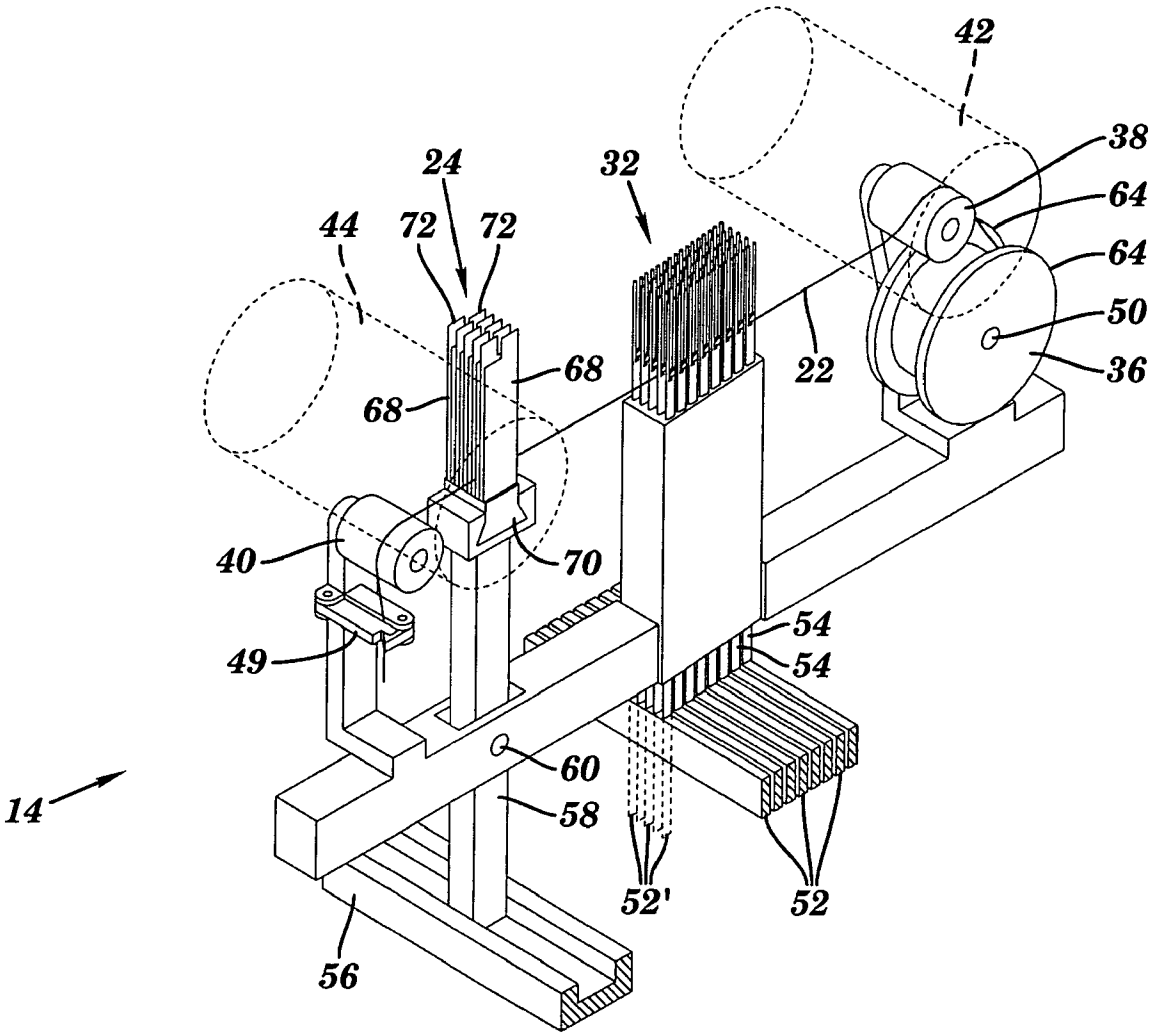
FIG. 3 is an isometric view, on an enlarged scale, of a warp unit portion of the embodiment of FIGS. 1 and 2, with warp-unit-actuating parts of the loom chassis, and portions thereof shown in phantom.
Figure 4:
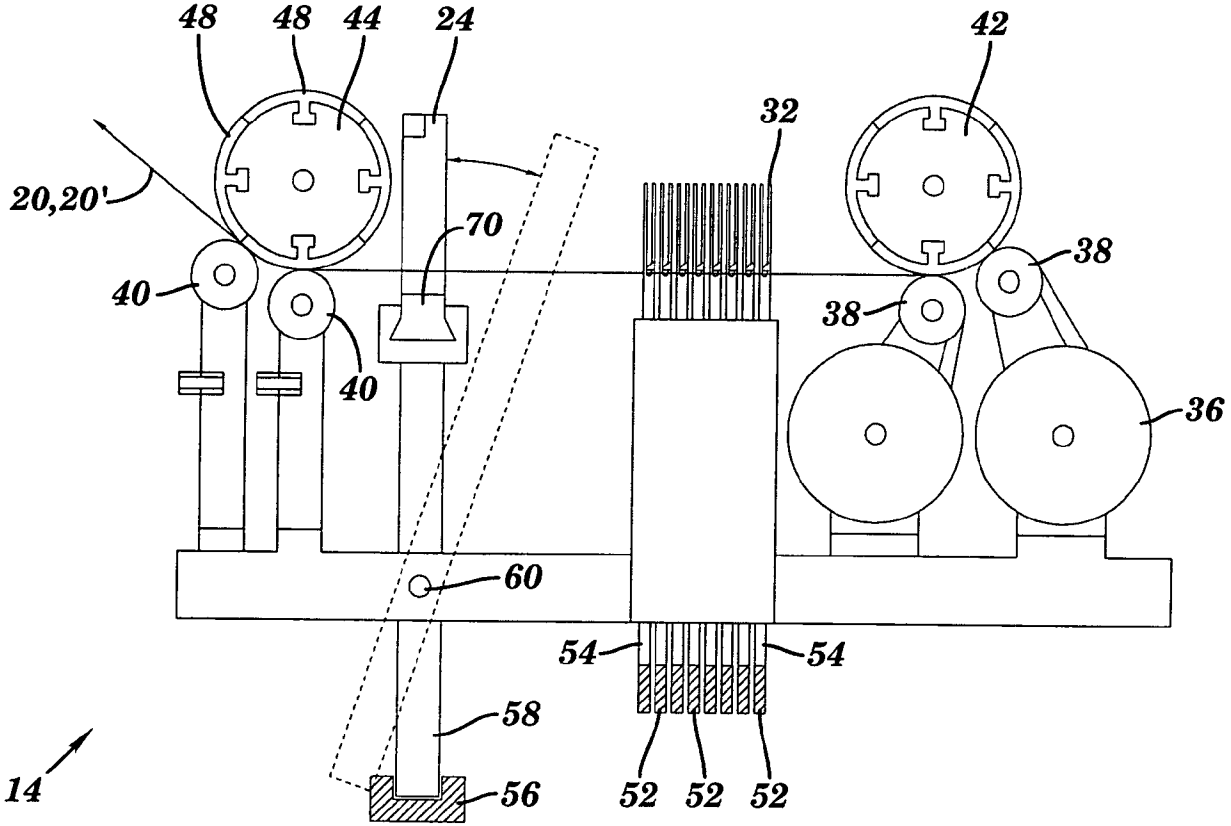
FIG. 4 is an elevational side view of the components of FIG. 3.

In this regard, warp loader 16 may be used to load warp thread 22 into warp units 14 for transport into chassis 12, 12'. This loading includes properly winding warp thread 22 into the units 14, and drawing the warp thread through integral heddles 32 and reed 24 (FIGS. 3 and 4).

Loading a warp unit is therefore analogous to conventional 'setting-up' and 'drawing-in' a loom. However, in such conventional looms, all drawing-in must generally occur before any weaving commences. This contrasts with the modular weaving machine 10, 10', in which the aforementioned use of discrete warp units 14 enables warp threads 22 to be set-up independently of the weaving operation, e.g., after weaving commences.

This mode of set-up also differs from typical automated set-up of conventional looms. Generally, conventional automated set-up is performed on all threads before moving to the next operation. That is, all warp threads are beamed (i.e., wound around a beam or spool) and then all are drawn-in, before weaving commences. Conversely, on machine 10, 10', all set-up operations are performed on a particular subset of threads 22 (i.e., those of a particular warp unit 14), before moving to the next group of threads 22.

Embodiments of the present invention thus provide a loom that tends to reduce downtime, by use of individual warp units that may be set-up off-line and subsequently inserted into the loom. These embodiments also facilitate the use of relatively short warp threads, e.g., to facilitate short production runs such as in batch mode operation. Moreover, these embodiments may also be operated in continuous mode, e.g., using relatively short warp threads, without limiting the overall length of the bolt of fabric produced thereby.

Furthermore, the ability to remove each warp unit from the loom chassis facilitates warp-thread set-up (e.g., warp thread loading) by enabling this operation to be performed away from other components (e.g. components of other warp units or components of the loom chassis). This means that the task of warp-thread set-up is simplified as compared to conventional looms, by virtue of increased mechanical access to and clearance around the warp-handling components.

Turning now to FIGS. 3-7C, various aspects of the present invention will be described in greater detail.

Warp Units

Referring to FIG. 3 in particular, each warp unit 14 stores unwoven warp threads 22 on a spool-like miniature beam 36. For clarity, only one thread 22 is shown, with the understanding that the warp units may be scaled to support substantially any number of warp threads, ranging from tens to hundreds of threads, depending on the weaving application. From one to forty threads 22 may be supported in the embodiment shown.

Within each warp unit 14, the warp threads 22 run from beam 36, over an upstream roller 38, through heddles 32, through a reed portion 24, and over downstream roller 40. Once the warp unit is installed into the loom chassis 12, 12', rollers 38 and 40 may be respectively engaged by common payout and take-up rollers 42 and 44 to control the pay-out of warp threads 22 and the take-up of the fabric 20, 20', as discussed in greater detail hereinbelow.

Prior to such insertion however, a clamp 49 may be disposed to maintain the positions of the warp threads 22 on the warp unit, e.g., while it is moved from loader 16 (FIGS. 1, 2) to the loom chassis 12, 12'. This clamp is released once the warp unit 14 is installed in the loom chassis 12, 12' and the warp threads 22 are engaged by rollers 42 and 44 as discussed below.

Similarly, each warp unit 14 may be equipped with an optional pay-out regulator 50 for regulating the pay-out of warp threads 22 at beam 36. This helps to maintain order among the warp threads while the warp unit is in transit from the warp loader to the loom chassis, e.g., before engagement of warps 22 by pay-out roller 42. Regulator 50 also helps prevent the possibility of tangling or other malfunction due to stray, slack threads between beam 36 and the upstream roller 38. Pay-out regulator 50 may simply be a slight interference fit between the beam and its axle, or any other tension- or displacement-regulating pay-out mechanism known in the textile industry.

Loom Chassis

As best shown in FIG. 4 (and in phantom in FIG. 3), the chassis 12, 12' supports common take-up roller 44 which may be driven in a conventional manner about its rotational axis to provide motive force to pull the warp threads 22 (i.e., in the woven fabric 20, 20', FIG. 4) through the loom as the fabric 20, 20' is woven. This motive force is provided by frictional engagement with the fabric, which is effected by squeezing the fabric against downstream roller 40 of each of the warp units currently engaged in the weaving operation.

The fabric engagement surface of common take-up roller 44 may include sections 48 that are constrained circumferentially and radially relative to the roller, but are configured to permit axial movement. This allows these sections 48 to be moved laterally (e.g., against a bias) with the fabric 20, 20' as the warp units similarly move during weaving operations as discussed below. In this regard, sections 48 are effectively pulled by frictional contact generated by the aforementioned squeezing of roller 44 against downstream roller(s) 40. Once a particular section 48 rotates sufficiently to disengage from fabric 20, 20', it may be biased back to its original position, such as by a spring or a cam.

In the embodiment shown, loom chassis 12 also supports the common pay-out roller 42 which helps (e.g., in combination with optional regulator 50) to control the rate at which warp threads 22 are pulled from beam 36. This common roller pinches the warp threads against upstream roller 38 of the warp units 14, providing a frictional connection with the unwoven warp threads.

The pay-out rate may be controlled by applying a torque to roller 42 or by specifying its angular velocity. As with take-up roller 44, sliding surface sections 48 may be used to allow the warp units and warp threads to move laterally relative to the loom chassis as the warp units 14 similarly move.

Although the foregoing embodiments show and describe common pay-out roller 42, those skilled in the art should recognize that in some alternate embodiments, pay-out roller 42 may be omitted, so that pay-out regulator 50 is the sole source of pay-out control for each warp unit 14. Moreover, pay-out roller 42 and/or regulator 50 may be supplemented or replaced by motors, gear trains, actuators, or any number of other devices configured to engage and urge rotation of beams 36 to ensure adequate tension on the warp threads 22.

In addition to supporting warp units 14 and the common pay-out and take-up rollers 42 and 44, the loom chassis 12, 12' also actuates various aspects of the warp units 14 and supports a weft (fill) insertion system. In this regard, loom chassis 12 includes common heddle actuators (e.g., lifting bars) 52 which slidably support ends 54 of heddles 32. Each actuator 52 may be individually moved toward and away from warp unit 14 (e.g., raised and lowered in the embodiment shown), to move the heddles 32 (and the warp threads 22 supported thereby) for shedding. As shown, each actuator 52 engages a subset of the heddles 32 of each warp unit 14, e.g., those heddles laterally aligned with the particular actuator/bar 52.

In this manner, each lifting bar 52 is somewhat analogous to a heddle frame of a conventional loom, in that it defines a set of heddles that are mechanically linked to one another in such a way as to lift and lower in unison. The lifted and lowered heddles cause the warp threads to form a shed through which weft (fill) threads may be passed.

In embodiments of the present invention, the sliding engagement of the actuator/bar 52 with ends 54 of these laterally aligned heddles 32 provides a convenient means for actuating the heddles even as the warp units 14 move laterally during weaving operations, as discussed in greater detail hereinbelow. Moreover, their lateral extension enables each actuator 52 to simultaneously engage ends 54 of heddles of a plurality of adjacent warp units 14, as also discussed hereinbelow.

Although heddle actuators 52 are shown and described as bars upon which ends 54 may slide, in alternate embodiments, individual pushers 52' (shown in phantom, FIG. 3) may respectively engage ends 54 to provide Jacquard-like functionality. When weaving with laterally-moving warp units, e.g. during continuous-mode weaving (FIG. 2), an individual pusher 52' may be brought into alignment with, and used to actuate, a series of different heddle ends 54 as weaving progresses. The pushers 52' therefore may remain laterally stationary relative to the loom chassis or be disposed to move laterally to match the movement of the warp units 14 over a finite distance.

Chassis 12 also includes a common actuating sley 56 which slidably engages a reed sley 58 of warp unit 14. This slidable engagement enables reed sley 58 to slide laterally in a manner similar to that of heddle ends 54 described above. The length of sley 56 also permits it to slidably engage reed sleys 58 of multiple warp units 14. However, rather than moving towards and away from warp units 14 in the manner of actuators 52, sley 56 is movable in the upstream/downstream directions, to pivot each reed portion 24 from an upstream position (shown in phantom) to a downstream position to effect beat-up upon insertion of weft (fill) threads 25 (FIGS. 1 and 2).

Chassis 12, 12' also supports a weft-insertion system, which, in the embodiments shown, includes a pair of weft insertion modules 26 and 28 (FIGS. 1 and 2). These modules pass weft (fill) thread in a conventional manner through sheds (of warp threads 22) formed by actuation of heddle actuators 52 (FIGS. 3 and 4) as discussed hereinabove. Although the weft-insertion system as shown includes two insertion modules, those skilled in the art should recognize that any number of systems may be used, including conventional rapiers or shuttles commonly used in the textile industry. Examples of various suitable weft-insertion systems are described by Lord, P. R., and M. H. Mohamed, on pages 289-324 of *Weaving: Conversion of Yarn to Fabric*. $2^{nd}$ ed. Shildon, England: Merrow Publishing, 1982.

Figure 5:
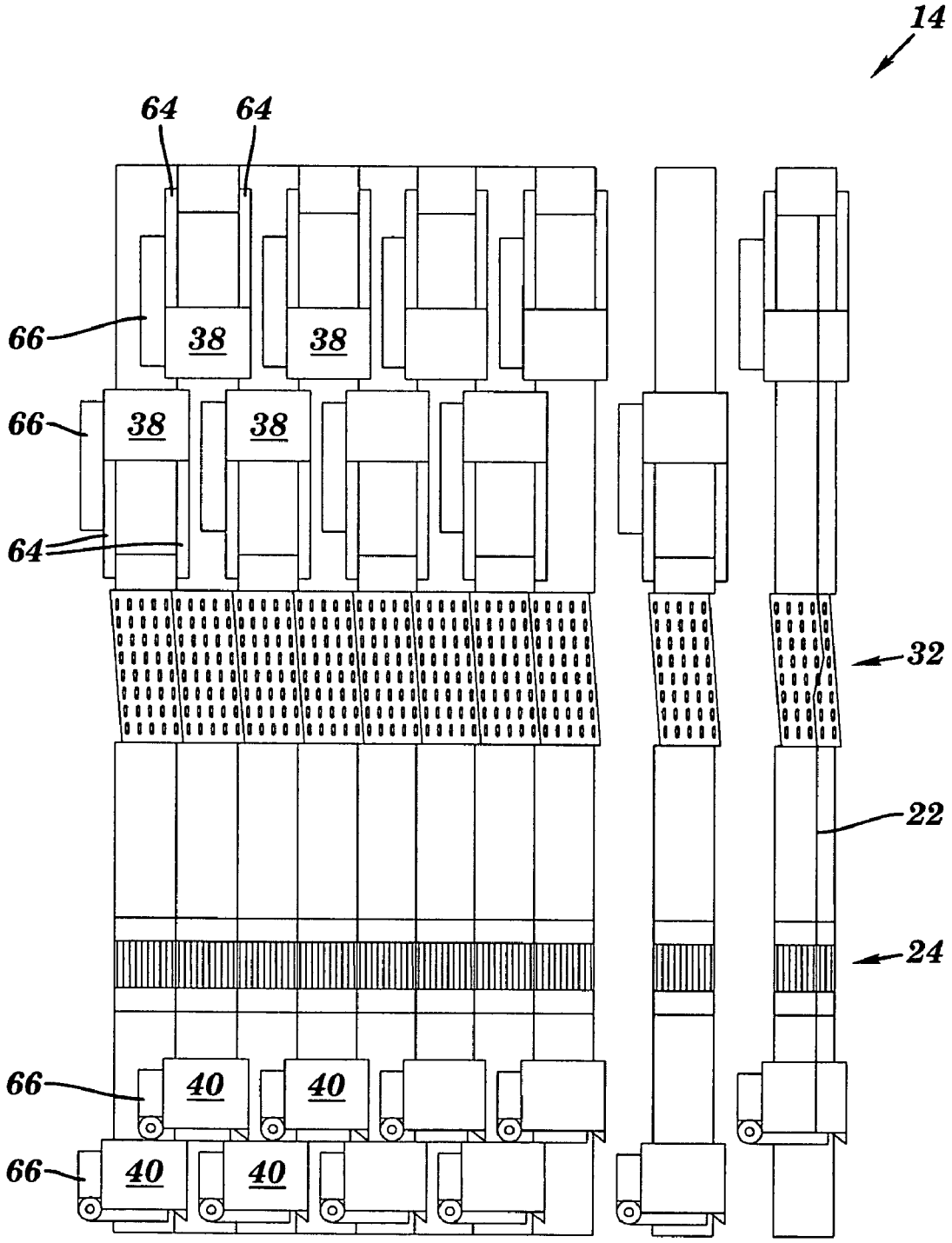
FIG. 5 is a plan view, on an enlarged scale, of the warp units of FIGS. 1 and 2, showing their nested configuration.

Turning now to FIGS. 4-5, as mentioned above, a plurality of warp units may be placed adjacent to one another in loom chassis 12, 12'. This enables warp threads 22 on each warp unit to be placed in parallel, spaced alignment with one another to form a warp sheet and heddle array that extend laterally the full width of the desired fabric 20, 20', i.e., 'weave-wide'. Similarly, the reed portions 24 of each warp unit effectively combine to form a weave-wide reed. This combination thus enables the array of adjacent warp units to effectively form a relatively wide loom and fabric.

As also shown, various components of each warp unit 14, however, may extend laterally beyond the strip of warp threads 22 supported thereby. These components may include flanges 64 of beams 36, rollers 38, 40, and structural supports 66 for these components. The rollers 38, 40, for example, are flangeless, and thus should be wider than the strip formed by the warp threads 22 to help ensure that the warp threads to do not fall off the edges thereof. Thus, in order to accommodate these requirements, adjacent warp units 14 are staggered in the downstream/upstream direction. This staggering or nesting thus enables adjacent warp units 14 to be disposed close enough to one another to provide uniform spacing between the warp threads 22, to enable production of a substantially seamless fabric (as described above).

Open Reed and Heddles

Figure 6A:
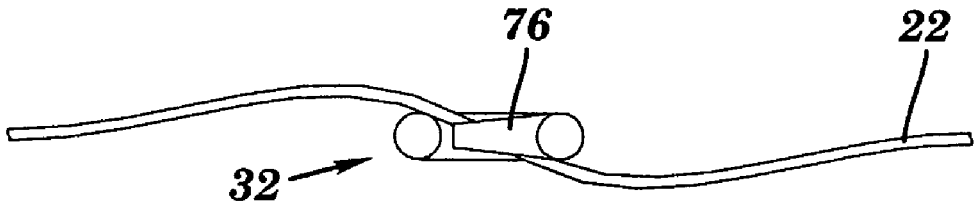
FIGS. 6A and 6B are plan and elevational views, respectively, on an enlarged scale, of heddle and thread portions of FIG. 5.
Figure 6B:
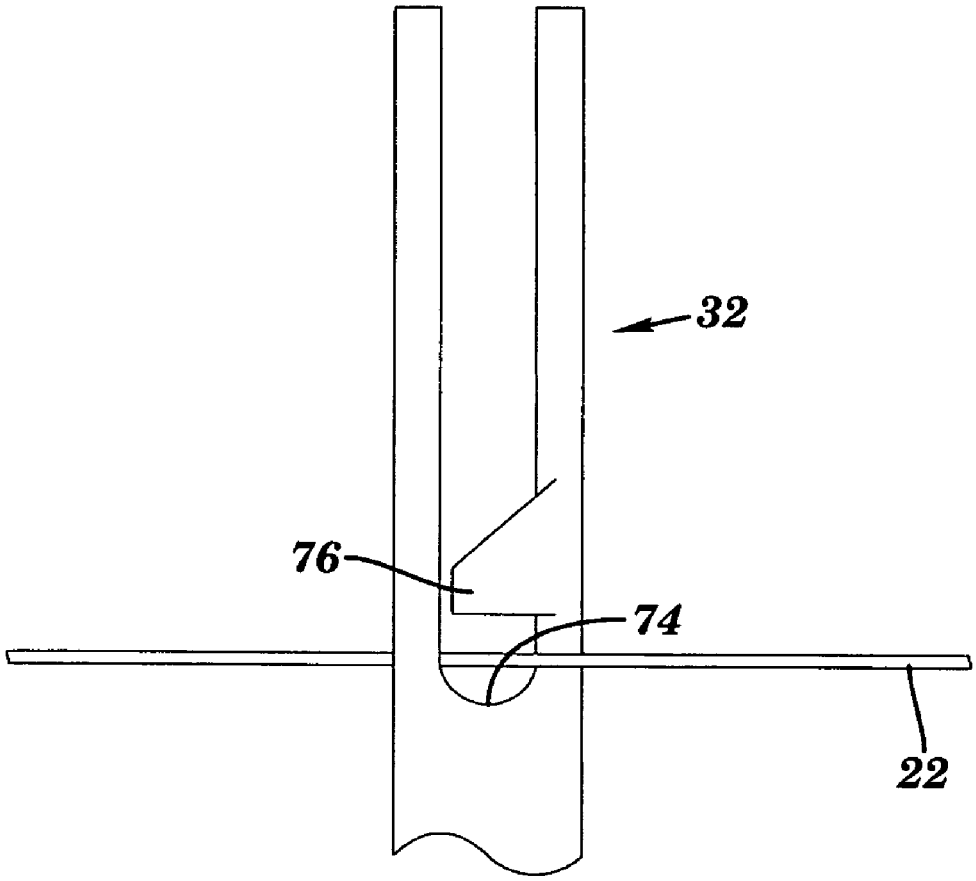

Turning now to FIGS. 6A, 6B, and 3, reed portions 24 and heddles 32 are provided with an open construction, to facilitate the loading of the warp units (discussed below). This open construction eliminates the need, common in the prior art, to push ends of the warp threads 22 through holes in the reed and/or heddles.

Rather, as best shown in FIG. 3, each reed portion 24 includes several cantilevered plates 68 with spaces (dents) between them, extending from a common block 70. Block 70 is supported by reed sley 58. The plates 68 are interposed among warp threads 22, e.g., with a single thread 22 disposed within each dent. During weaving operations sleys 56, 58 are operated as discussed hereinabove, to cycle plates from an upstream position (shown in phantom in FIG. 4) to a downstream position once weft threads 25 are inserted. In this manner, plates 68 cyclically push ('beat-up') the weft thread in the downstream direction after insertion, to form fabric 20, 20'. In particular embodiments, reed portions 24 may be replaced with other reed portions having a different number and size of dents, to permit a user to adjust the sett (warp thread spacing) of the finished fabric 20, 20'.

Warp threads 22 are initially disposed within the dents by placing the threads between the distal ends of the appropriate plates 68. To facilitate this placement, the distal ends may be provided with alternating tabs 72 that may be engaged to bend the plates laterally. By releasing the tabs in an alternating fashion, the plates may be conveniently released one-by-one, to open sequential dents for loading. Such engagement may be conveniently automated, using any number of well-known approaches. Plates 68 are thus sufficiently thin (i.e., in their lateral dimension) and long to enable their distal ends to be easily moved in the lateral direction upon engagement of tabs 72. They are also sufficiently wide (i.e., in the downstream direction), and their point of engagement with the fell (weft threads) sufficiently close to the support block 70, to provide a stiffness and strength sufficient to resist the beat-up forces.

As best shown in FIGS. 6A and 6B, heddles 32 are forklike, e.g., having two tines. The material connecting the tines, i.e., the bight portion 74 thereof, engages and lifts warp thread 22 when the heddle is lifted. A fluke or barb 76, extending from at least one tine (possibly extending to, or preloading against, the other tine) effectively captures thread 22 within the heddle, to help prevent the thread from becoming disengaged from the heddle during weaving operation. During such operation, heddle 32 may use fluke 76 to effectively pull the thread (e.g., in the downward direction). Alternatively, the heddle may operate primarily by pushing (i.e., against bight 74), using fluke 76 primarily as a safety measure to prevent thread 22 from becoming stuck, for example, in the up position. The tines are relatively elongated, typically extending above the top of the shed formed during weaving operation, to help prevent neighboring warp threads 22 from accidentally entering heddle 32, and provide smooth surfaces for the neighboring threads to rub against, such as shown in FIG. 5.

As also shown in FIG. 5, heddles 32 are arranged on the warp units 14 so their lateral positions substantially match those of the warp threads 22 at maximum thread density. In the event a substitute reed portion having alternate dent spacing is being used, warp threads may simply be placed in heddles that reasonably approximate this alternate spacing. Heddles 32 may be offset from one another in the upstream/downstream direction as shown, to compensate for the large lateral dimension of the heddles relative to the width of threads 22. This offsetting also provides relatively large spacing between the heddles 32, to facilitate loading thereof. To load the thread, the thread is placed between the tines, and pushed below the projection, possibly bending the tines as needed.

Warp Loading

Figure 7A:
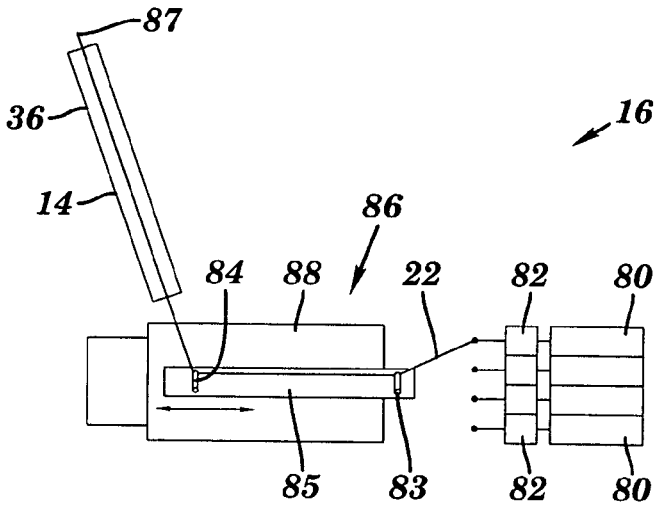
FIGS. 7A, 7B and 7C are schematic plan, front and side views of an embodiment of a warp loader of the present invention.
Figure 7B:
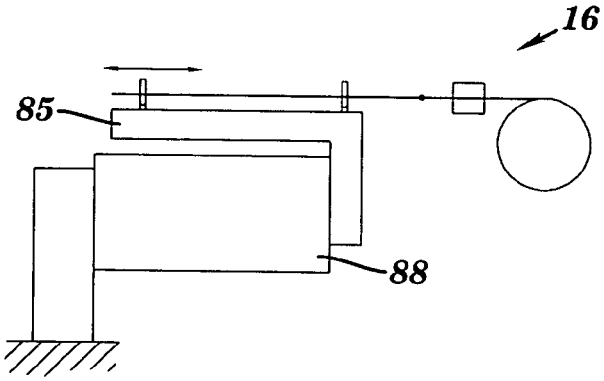
Figure 7C:
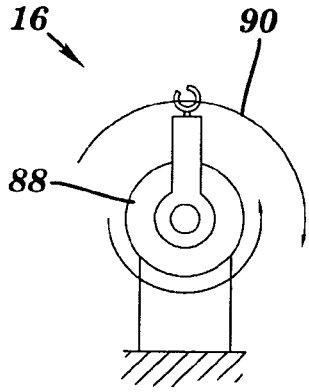

Turning now to FIGS. 7A-7C, warp loader 16 may be provided with several spools 80 of thread 22, likely of different colors and/or materials. Each thread 22 from a spool 80 may be tensioned by its own tensioner 82. To load a warp thread 22 into a warp unit 14, a thread is selected, pulled through respectively stationary and movable guides 83, 84 of arm 85 of a warp accumulator 86. The thread is then pulled over the warp unit 14 to be loaded, and its end 87 is gripped and held at the end of the warp unit 14 proximate beam 36. Then, the thread is introduced into a heddle 32 and reed 24 (FIG. 5) as described hereinabove. Either during or after this introduction, the thread 22 is accumulated on drum 88 of accumulator 86.

This accumulation is accomplished by rotating accumulator arm 85 about drum 88, as shown at 90 in FIG. 7C, while moving thread guide 84 in the axial direction, to wrap the thread helically around accumulator drum 88. The thread is wrapped onto the drum surface, parallel to any other warp threads that have been previously wrapped. This wrapping draws additional thread from the spool 80. When the requisite amount of thread 22 has been wrapped, the thread is gripped to the drum and cut from spool 80.

This accumulation process is repeated serially for each thread that is to be loaded into warp unit 14. When all the warp threads to be loaded have been so processed, the ends 87 of the parallel warp threads 22 are each anchored to beam 36 on the warp unit 14. Then beam 36 and accumulator drum 88 are simultaneously rotated, to feed the set of parallel warp threads 22 from drum 88 onto beam 36. Warp unit 14 may move relative to drum 88 to follow the point where the helix unwinds therefrom.

Once loaded, warp units 14 may be installed into loom chassis 12, 12' using a transport device 34, 34' (FIGS. 1 and 2) associated with warp loader 16. Transport devices 34, 34' may be nominally any conveyance device known to those skilled in the art, including conveyor belts, roller systems, and/or robotic actuators of the type commonly used in conventional factory automation systems. Transport device 34' (FIG. 2) also provides the motive force for moving warp units 14 laterally within loom chassis 12, 12' as discussed herein.

Modes of Operation

Having described various aspects of embodiments of the present invention, the following is a description of the weaving operations thereof. Embodiments of the modular weaving machine may be operated in two modes: batch or continuous, as respectively shown in FIGS. 1 and 2. Turning to FIG. 1, when in batch mode machine 10 produces a rectangular bolt of fabric 20, with the warp threads 22 running parallel to the fabric edge. This may be accomplished by filling warp units 14 as discussed hereinabove, and placing sufficient numbers of them onto loom chassis 12, 12' to achieve a desired fabric width. Weaving is then commenced, and continued without adding or removing warp units, until they are exhausted of warp thread, at which time weaving is terminated and the warp units removed. In this batch mode, the length of fabric 20 is limited by the length of warp thread 22 loaded onto warp units 14. However, while weaving one bolt of fabric, additional warp units for the next bolt of fabric may be loaded, to minimize downtime of loom 10.

As shown in FIG. 2, when in continuous mode, loom 10' may produce an indefinitely long strip of fabric 20', with the warp threads 22 running at an angle $\alpha$ to the longitudinal axis a of the fabric 20'. (The weft threads 25 are perpendicular to warp threads 22). Once weaving commences, the warp units may be moved laterally (e.g., to the left as shown at 92, so that newly-loaded warp units 14 may be added periodically to one side (e.g., the right side) of the loom chassis 12, 12', as emptied warp units 14 are removed from the other (left) side. In this manner, replacement warp units 14 may be loaded while others are actively involved in the ongoing weaving process. Accordingly, weaving may progress indefinitely, with virtually no loom downtime, regardless of the length of the warp threads 22.

Alternate Embodiment

Figure 8:
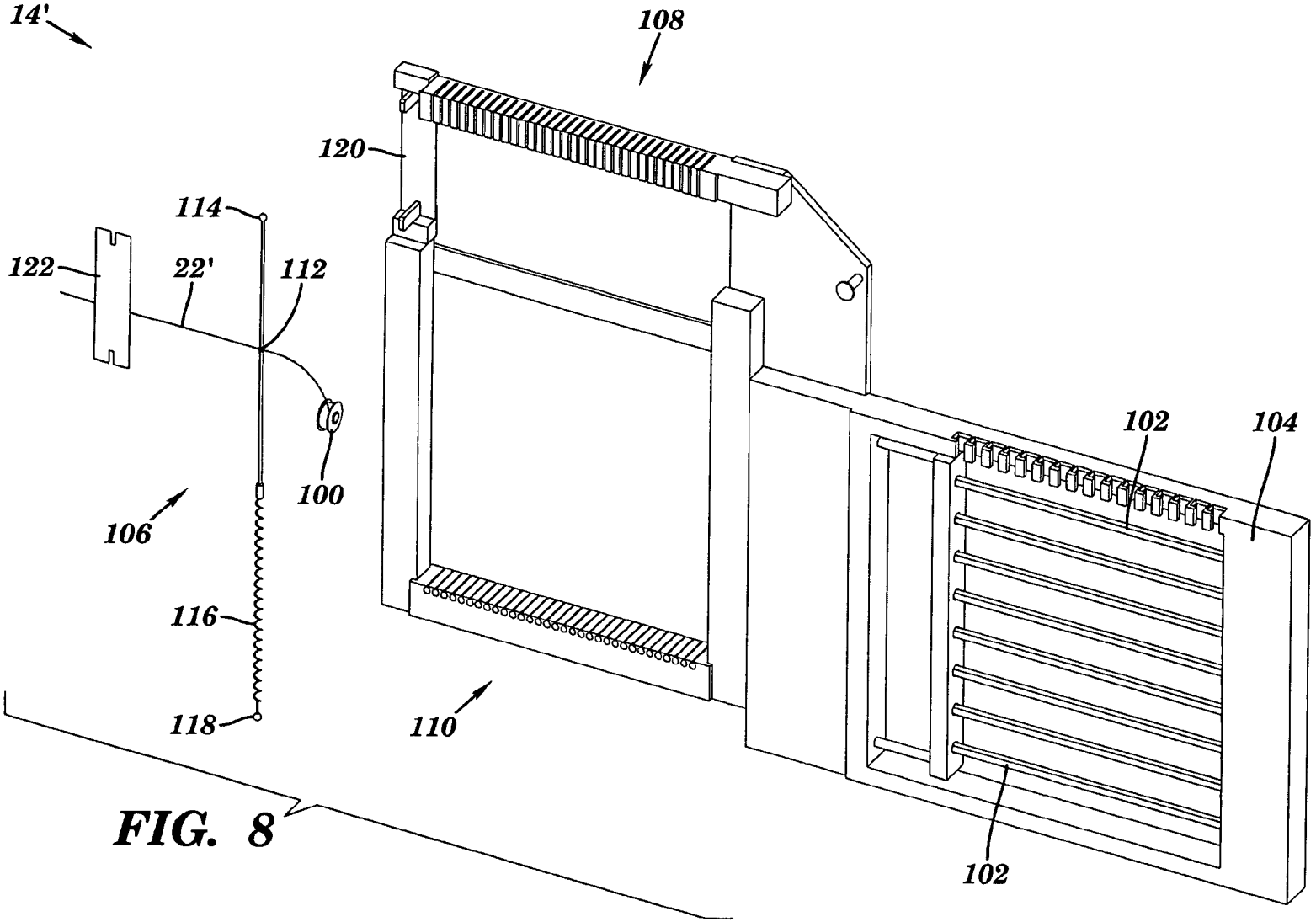
FIG. 8 is a perspective, exploded view of a warp unit of an alternate embodiment of the present invention, with portions omitted for clarity.
Figure 9:
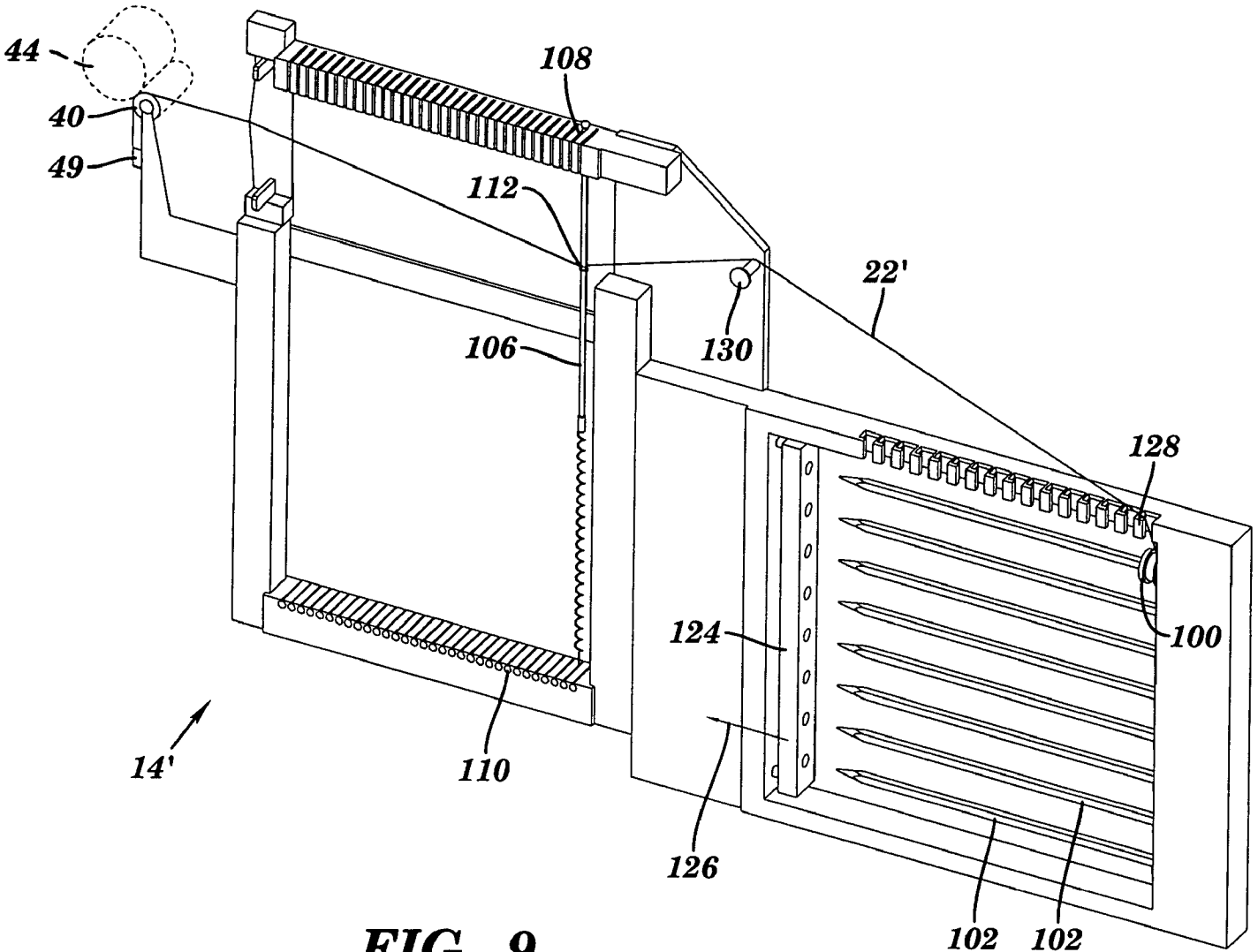
FIG. 9 is a perspective view of the warp unit of FIG. 8, carrying a single bobbin, warp thread, and heddle, with portions of a chassis into which the warp unit is installed shown in phantom.
Figure 10:
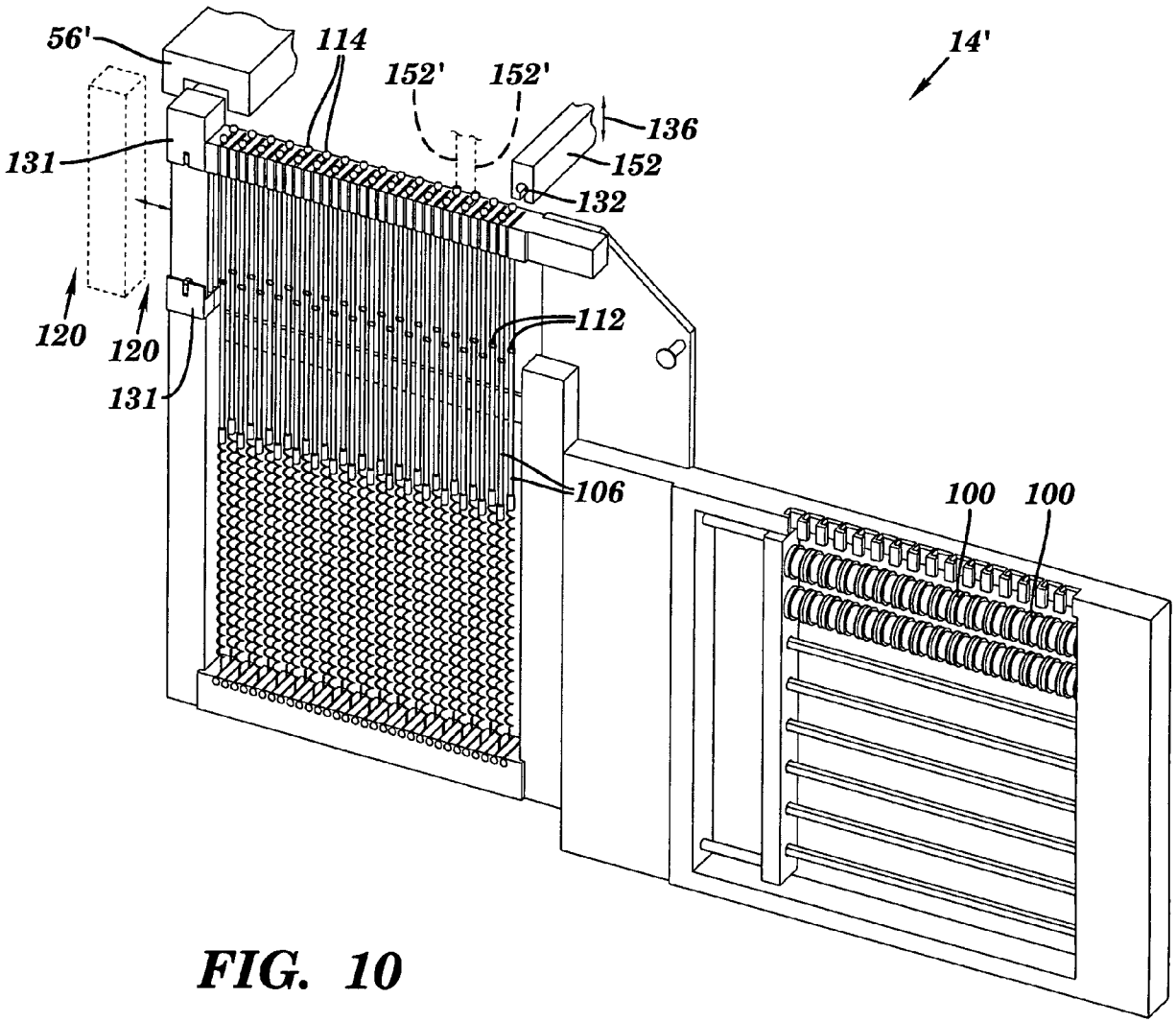
FIG. 10 is a perspective view of the warp unit of FIGS. 8 and 9, carrying a plurality of warp-carrying bobbins, heddles, and reed blades mounted within a closed reed, with portions omitted for clarity and portions shown in phantom to indicate movement.

Turning now to FIGS. 8-10, an alternative embodiment of the warp unit is shown at 14'. In this embodiment, warp unit 14' is provided with features that may further enhance modularity for improved efficiency. For example, warp unit 14' is configured to support a plurality of discrete bobbins 100 to further simplify the loading of warp threads 22'. As shown, warp unit 14' supports one or more spindles 102, which, in particular configurations, may be rotatably driven about their axes by a conventional drive means such as a motor and drive train (not shown) disposed within a spindle drive portion 104 of the warp unit. The spindles 102 are configured to receivably support one or more bobbins 100 coaxially thereon (FIGS. 9, 10), so that the bobbins may rotate about their axes to pay out warp threads 22' as will be discussed below.

As also shown, warp unit 14' includes provisions for supporting a plurality of quick-release heddles 106, that may be quickly and conveniently installed and removed to facilitate the loading of warp threads 22'. This quick-release aspect may be particularly useful in applications for which closed heddles are desired. For example, in the particular embodiment shown, heddles 106 are elongated members having a closed (e.g., circular) eyelet 112 through which warp threads 22' are threaded (FIGS. 8, 9). An actuator fitting 114 is disposed at one end of heddle 106, while the other end is secured to a spring 116 that terminates at a catch 118.

The (e.g., lower) slot 110 is sized and shaped to slidably receive the catch 118 and spring 116 from the lateral (e.g., horizontal, in the orientation shown) direction, while constraining the catch against upward movement (i.e., against movement towards slot 108). Similarly, the other (e.g., upper) slot 108 is shaped to slidably receive the fitting 114 and heddle 106 from the lateral, (e.g., horizontal) direction, while constraining the fitting against downward movement (i.e., against movement towards slot 110).

Directional terms used herein, such as 'upper', 'lower', 'horizontal', etc., are used merely for convenience, referring simply to the representative component orientations shown in the attached Figures. It should be recognized that various components described herein may be mounted in other orientations, with correspondingly modified directional terms, without departing from the scope of the present invention.

The heddles 106 thus may be installed onto the warp unit 14' simply by engaging fitting 114 and catch 118, pulling them against the bias of spring 116, inserting the heddle/spring (e.g., from the horizontal, lateral direction in the orientation shown) into slots 108, 110 and then releasing the heddle. Upon release, the bias of spring 116 effectively captures fitting 114 and catch 118 on the warp unit as best shown in FIGS. 9 and 10. This installation may be reversed to quickly release heddles 106 from warp unit 14'.

Moreover, although heddles 106 are shown and described as being configured for quick-release from warp units 14' along with springs 116, it should be recognized that the heddles may be removed independently of the springs 116, e.g., with the springs permanently mounted to warp unit 14' and the heddles being releasably hooked or otherwise fastened to the spring, without departing from the scope of the present invention.

Thus, in this embodiment, the warp threads 22' are each captured within a closed heddle portion (eyelet) 112 to help prevent inadvertent release of the threads during demanding weaving operations. The quick-release nature of the heddles 106 mitigates any difficulty otherwise associated with threading closed heddles, by enabling the threading to occur offline, i.e., before installation onto warp unit 14'.

As also shown, each warp unit 14' removably supports a reed bracket 120 configured to support a plurality of reed blades 122. Once fully loaded with blades 122, reed bracket 120 effectively forms a closed reed assembly that may be moved by a suitable reed sley 56' to effect beat-up operations, as will be discussed in greater detail hereinbelow. As with the closed heddle eyelets 112 discussed above, the closed nature of the reed assembly may help prevent inadvertent release of the threads 22' during particular weaving applications. The modular nature of the reed blades overcomes the difficulties traditionally associated with conventional closed reeds, by facilitating loading of the warp threads. Those skilled in the art will also recognize that the various operational steps associated with this embodiment, including the winding of bobbins, threading of heddles, installation of the bobbins and heddles, and/or assembly of the various reed blades 122 onto reed bracket 120 may be conveniently automated, e.g., using robotic equipment and the like, as may be associated with a modified version of loader 16. Once loaded, the reed bracket 120, and all of the blades 122 supported thereon, may be moved as a unit, e.g., by reed sley 56', to effect beat-up operations as discussed in greater detail hereinbelow.

Warp units 14' are received within a loom chassis 12' which includes a weft-insertion system which may include weft insertion modules 26, 28 (FIGS. 1, 2) described hereinabove. Chassis 12' also includes a plurality of heddle actuators 152, 152' configured to engage the heddles at their actuator fittings 114 either singly (as in Jacquard weaving) or in rows to move the warp threads 22' away from and toward warp unit 14' (e.g., to raise and lower threads 22') during weaving.

For example, heddle actuators 152 (FIG. 10) may include a keyway 132 sized and shaped slidably receive actuator fittings 114 therein upon movement of warp unit 14' in the lateral direction 92 (FIG. 2). Once fittings 114 are received therein, heddle actuators 152 may be actuated to alternately move heddles 106 against and with the bias of springs 116 such as shown by arrow 136. As shown, each actuator 152 engages a subset of the heddles 106 of each warp unit 14', e.g., those heddles laterally aligned with the particular actuator/bar 152. In this manner, each lifting bar 152 is somewhat analogous to a heddle frame of a conventional loom, in that it defines a set of heddles that are mechanically linked to one another in such a way as to lift and lower in unison. The lifted and lowered heddles cause the warp threads to form a shed through which weft (fill) threads may be passed.

As with embodiments of FIGS. 3, 4 discussed above, the sliding engagement of the actuator/bar 152 with these laterally aligned heddles 106 provides a convenient means for actuating the heddles even as the warp units 14' move laterally during weaving operations. Moreover, each actuator 152 may simultaneously engage fittings 114 of a plurality of adjacent warp units 14' to function in a manner as discussed hereinabove with respect to warp units 14.

Although heddle actuators 152 are shown and described as bars upon which fittings 114 may slide, in alternate embodiments, individual actuators 152' (shown in phantom, FIG. 10), such as magnetized hooks or robotic jaws, may respectively engage individual fittings 114 to provide Jacquard-like functionality. When weaving with laterally-moving warp units, e.g. during continuous-mode weaving (FIG. 2), an individual hook 152' may be brought into alignment with, and used to actuate, a series of different heddle fittings 114 as weaving progresses. The hooks 152' therefore may remain laterally stationary relative to the loom chassis or be disposed to move laterally to match the movement of the warp units 14' over a finite distance.

Chassis 12' also includes a reed sley or carriage 56' that engages (e.g., slidably, upon lateral movement of warp unit 14') the reed brackets 120. Upon such receipt, carriage 56' alternately moves the brackets 120 from the upstream position as shown, to a downstream position as shown in phantom, to effect the otherwise conventional beat-up of weft thread.

This slidable engagement enables reed brackets 120 to slide laterally in a manner similar to that of heddle fittings 114 described above. The length of carriage 156 also permits it to slidably engage brackets 120 of multiple warp units 14'.

The slidable engagement between the carriage 56' and reed bracket 120 may be in the form of a dovetail or similar contrivance that acts to constrain additional degrees of freedom of reed bracket 120 to adequately control its spatial location (e.g. resist vertical movement). The use of other engagements, in the form of rails, slots, releasable gripping devices, or other devices known to those skilled in the art may be employed in addition to or instead of the dovetail.

It should be understood that features of the various embodiments shown and described herein may be combined with one another without departing from the scope of the present invention. For example, the bobbins 100 and spindles 102 of FIGS. 8-10 may be readily combined by one skilled in the art with the open heddles 32 and reeds 24 of the embodiment of FIGS. 3-7C.

Having described various components of warp unit 14' and associated elements of chassis 12', an exemplary operation of a system incorporating these components will be described with reference to the Figures and to Table I below. For convenience, this system will be described for an embodiment in which each bobbin 100 is loaded with only a single warp thread 22', with the understanding that each bobbin may alternatively be loaded with a plurality of threads, such as in the manner discussed hereinabove with respect to beam 36, without departing from the present invention.

TABLE I

| | |
|---|---|
| 180 | Wind warp threads onto bobbin |
| 184 | Thread heddle |
| 186 | Open one end of spindles |
| 188 | Load wound bobbin and threaded heddle into the warp unit |
| 190 | Route thread through guide means |
| 192 | Secure thread at its free end |
| 194 | Repeat steps 180-192 for additional bobbins and heddles |
| 196 | Insert reed blade into the reed bracket |
| 198 | Repeat steps 180-196 until reed bracket has desired complement of reed blades |
| 199 | Close reed bracket |
| 200 | Install warp unit(s) onto loom chassis |
| 202 | Release free ends of threads |
| 204 | Optionally tension threads |
| 206 | Actuate heddle actuators |
| 208 | Actuate weft insertion modules |
| 210 | Beat-up weft |
| 211 | Repeat steps 206-208 as desired |
| 212 | Replace empty warp units |

Turning now to FIG. 8, operation commences with an empty warp unit 14', i.e., one that carries no bobbins 100 or heddles 106. Reed bracket 120 is similarly empty, carrying no reed blades 122. Initially, prior to being loaded onto the warp unit 14', one or more warp threads 22' are wound 180 onto a bobbin 100. This bobbin winding operation may be effected using any number of approaches known to those skilled in the art, such as using a simplified version of warp loader 16 (FIGS. 7A-7C), e.g., to wind a single thread onto a bobbin 100 substituted for drum 88. This winding of threads on separate bobbins eliminates the need for a two-step approach of first winding multiple threads onto a drum 88 and then transferring these threads to a separate beam 36 such as shown and described with respect to FIG. 7A. However, this two-step approach may be used to wind multiple threads onto each bobbin, such as to increase the warp thread count in a particular application.

Once the bobbin is wound, the free end of each wound thread 22' is fed (threaded) 184 into the eyelet 112 of a heddle 106. Turning now to FIG. 9, one end of the spindle(s) 102 is opened 186, and the wound bobbin 100 and threaded heddle 106 are loaded 188 into the warp unit 14'. In the embodiment shown, this bobbin installation is effected by opening 188 one end of spindles 102, such as by sliding end support 124 axially as shown at 126. The threaded heddle 106 is installed onto a pair of opposed slots 108, 110, while the thread 22' is routed 190 through guide means, e.g., guides 128 and 130 as shown. Those skilled in the art will recognize that nominally any guide configuration (which may include the omission of guides in some embodiments) may be used as desired to help prevent tangling or chaffing, etc., of the thread during weaving operations. The thread 22' may be secured 192 at its free end by a clamp, brush, or other means known to those skilled in the art, such as clamp 49 and roller 40.

In the embodiment shown, a plurality of threads 22' may be disposed between adjacent reed blades 122 (i.e., in a 'dent' formed by adjacent blades 122). As such, the aforementioned loading operation may be repeated 194 for additional bobbins 100 and heddles 106. Once a desired predetermined number of warp threads 22' have been placed into the dent a reed blade 122 may be inserted 196 into reed bracket 120. Steps 180-196 may then be repeated 198 until reed bracket 120 has a desired number of warp threads 22' and reed blades 122 therein. The reed bracket 120 may then be closed 199 with end caps 131 (FIG. 10). Thus, as shown in FIG. 10 (which omits the warp threads for clarity), warp unit 14' may be conveniently loaded with a plurality of discrete bobbins 100, closed heddles 106, and a closed reed bracket 120.

It should be noted that one or more of the foregoing steps 180-199 associated with loading the warp units 14' may be effected automatically, e.g., by modified versions of warp loader 16 as mentioned hereinabove.

A plurality of loaded warp units 14' may be installed 200 into a loom chassis 12' as shown and described with respect to FIGS. 1 and 2 hereinabove, e.g., automatically using a transport device 34, 34'. Upon installation, take-up roller 44 (FIGS. 3, 4, 9) of loom chassis 12' engages rollers 40 (FIGS. 3, 4, 9) of the warp units 14', to secure the warp threads 22' therebetween, in the manner shown in FIGS. 3 and 9, to permit clamp 49 to be released 202 as shown in FIG. 4. The threads 22' may be tensioned 204, such as by rotating spindles 102 in a direction that tends to pull the threads 22 in the upstream direction. In particular embodiments, sufficient friction is provided between the spindles 102 and bobbins 100 so that the upstream rotation of the spindles 102 provides an upstream bias to the warp threads 22' that may be overcome by the downstream bias generated by take-up roller 44 (shown in phantom). This friction between the spindles 102 and bobbins 100 thus maintains a substantially constant tension in the warp threads 22' between bobbins 100 and take-up roller 44. Moreover, although friction between the spindles 102 and bobbins 100 is described, the skilled artisan will recognize that that numerous alternate approaches may be used to provide such thread tension, such as a system of clutches configured to prevent the pay out of thread from the bobbins until sufficient thread tension is detected.

Weaving may then be effected in substantially the same manner as described hereinabove with respect to FIGS. 1-7C, e.g., by actuating 206 heddle actuators 152, 152' to create a shed, inserting 208 weft threads therethrough using weft insertion modules 26, 28, and by actuating 210 reed sley or carriage 56' to beat-up the weft thread. Steps 206-208 may be repeated 211 as desired. As the bobbins are emptied of thread, the warp units 14' may be replaced 212 either as a group or individually, using modules 34, 34'.

In the preceding specification, the invention has been described with reference to specific exemplary embodiments thereof. It will be evident that various modifications and changes may be made thereunto without departing from the broader spirit and scope of the invention as set forth in the claims that follow. The specification and drawings are accordingly to be regarded in an illustrative rather than restrictive sense.

Having thus described the invention, what is claimed is:

1. A modular weaving machine comprising:

a loom chassis;

a plurality of modular warp units;

said warp units each supporting a plurality of removable bobbins thereon;

said bobbins configured for being pre-loaded with a plurality of warp threads;

said loom chassis configured to receivably support said warp units thereon, wherein said warp threads of each of said warp units are disposed in parallel, spaced relation to one another, extending from said bobbins in a downstream direction;

a plurality of shedding actuators coupled to said loom chassis, and configured to form a shed with warp threads of each of said warp units; and a weft insertion module configured to insert a weft thread through the shed.

2. The modular weaving machine of claim 1, wherein said bobbins are supported on a plurality of rotatable supports.

3. The modular weaving machine of claim 2, wherein said rotatable supports are disposed to rotate continuously during weaving operation.

4. The modular weaving machine of claim 2, wherein said rotatable supports are disposed to bias the warp threads in an upstream direction to maintain tension in the warp threads during weaving operation.

5. The modular weaving machine of claim 1, wherein said warp units each releasably support a plurality of quick-release heddles, each of said quick-release heddles configured for respectively receiving one of said warp threads.

6. The modular weaving machine of claim 5, wherein said quick-release heddles are spring loaded.

7. The modular weaving machine of claim 5, wherein said shedding actuators comprise heddle actuators.

8. The modular weaving machine of claim 7, wherein said shedding actuators are configured to selectively actuate said heddles of each of said warp units to form the shed.

9. The modular weaving machine of claim 1, wherein said warp units each releasably supports a modular reed, said modular reed including a plurality of detachable blades configured for being interspersed among said warp threads.

10. The modular weaving machine of claim 9, wherein said warp units are configured for being loaded with said warp thread when disposed out of said loom chassis.

11. The modular weaving machine of claim 9, wherein said reed and said heddles are configured for being closed in directions transverse to the downstream direction.

12. The modular weaving machine of claim 9, wherein said loom chassis comprises a common actuating sley disposed to engage and commonly actuate said reeds of said warp units.

13. The modular weaving machine of claim 1, comprising a transport system disposed to selectively deposit and withdrawal individual ones of said warp units to and from said loom chassis.

14. The modular weaving machine of claim 13, wherein said transport system is disposed to selectively deposit and withdraw individual ones of said warp units to and from said loom chassis substantially during weaving operations.

15. The modular weaving machine of claim 1, wherein said loom chassis is configured for cycling said warp units transversely to the downstream direction.

16. The modular weaving machine of claim 15, comprising a take-up roller disposed on said loom chassis, said take-up roller having a fabric engagement portion configured to move laterally with the fabric during fabric take-up.

17. The modular weaving machine of claim 1, comprising a warp loader configured for loading one or more warp threads into a bobbin.

18. The modular weaving machine of claim 17, comprising a transport device configured for installing the loaded warp units into said loom chassis.

19. The modular weaving machine of claim 17, wherein said warp loader is configured to draw a warp thread of each bobbin through a quick-release heddle and to install said bobbin and said heddle onto one of said warp units.

20. A method of weaving, comprising:

(a) pre-winding a plurality of warp threads onto a plurality of bobbins;

(b) loading a plurality of the bobbins onto a plurality of modular warp units, wherein the warp threads extend in parallel, spaced relation, in a downstream direction from the bobbins;

(c) placing said warp units onto a loom chassis configured to receivably support said warp units therein, wherein the warp threads of each of said warp units are disposed in parallel, spaced relation to one another;

(d) forming a shed of said warp threads with a shedding actuator coupled to the loom chassis; and (e) inserting a weft thread through the shed with a weft insertion module coupled to the loom chassis.

21. The method of claim 20, further comprising:

(f) during said forming (d) and said inserting (e), pre-winding another plurality of bobbins and loading the other bobbins into other modular warp units.

22. The method of claim 20, wherein said pre-winding (a) comprises threading said warp threads through a plurality of quick-release heddles.

23. The method of claim 22, wherein said loading (b) comprises loading the threaded quick-release heddles onto the warp units.

24. The method of claim 20, wherein said loading (b) comprises extending the warp threads into a reed housing.

25. The method of claim 24, wherein said loading (b) comprises interspersing reed blades among the warp threads within the reed housing to form a plurality of reed dents.

26. The method of claim 20, wherein said loading (b) is effected when the warp units are disposed out of the loom chassis.

27. The method of claim 22, comprising selectively actuating the heddles of each of said warp units to form the shed.

28. The method of claim 24, comprising collectively actuating the reed housings of each of said warp units with a common actuating sley to beat-up the weft thread.

29. The method of claim 20, comprising selectively depositing and withdrawing individual ones of the warp units to and from the loom chassis.

30. The method of claim 29, wherein said selectively depositing and withdrawing is effected between said forming (d) and said inserting (e).

31. The method of claim 20, wherein said loading (a) comprises using a warp loader to simultaneously load a plurality of warp threads into a single bobbin.

32. A modular weaving machine comprising:

a plurality of modular warp unit means for supporting a plurality of removable bobbin means thereon;

said bobbin means each configured for being pre-loaded with a plurality of warp threads;

chassis means for receivably supporting said warp unit means thereon, wherein said warp threads of each of said warp unit means are disposed in parallel, spaced relation to one another, extending in a downstream direction from the bobbin means;

a plurality of shedding actuation means for forming a shed with warp threads of each of said warp units, said shedding actuation means being coupled to said loom chassis means; and weft insertion means for insert weft thread through the shed.

33. A modular weaving machine comprising:

a loom chassis;

a plurality of modular warp units;

said warp units each configured for being pre-loaded with a plurality of warp threads;

said warp units configured to releasably support a plurality of quick-release heddles;

said loom chassis configured to receivably support said warp units thereon, wherein said warp threads of each of said warp units are disposed in parallel, spaced relation to one another, extending in a downstream direction;

a plurality of shedding actuators coupled to said loom chassis, and configured to form a shed with warp threads of each of said warp units; and a weft insertion module configured to insert weft thread through the shed.

34. A modular weaving machine comprising:

a loom chassis;

a plurality of modular warp units;

said warp units each configured for being pre-loaded with a plurality of warp threads;

said modular warp units removably supporting a reed bracket configured to removably support individual reed blades thereon;

said loom chassis configured to receivably support said warp units thereon, wherein said warp threads of each of said warp units are disposed in parallel, spaced relation to one another, extending in a downstream direction;

a plurality of shedding actuators coupled to said loom chassis, and configured to form a shed with warp threads of each of said warp units; and a weft insertion module configured to insert weft thread through the shed.

35. A method of weaving, comprising:

(a) loading a plurality of quick-release heddles threaded with warp threads extending therethrough, onto a plurality of modular warp units, wherein the warp threads extend in parallel, spaced relation thereon;

(b) placing said warp units onto a loom chassis configured to receivably support said warp units therein, wherein the warp threads of each of said warp units are disposed in parallel, spaced relation to one another;

(c) forming a shed of said warp threads with a shedding actuator coupled to the loom chassis;

(d) inserting a weft thread through the shed with a weft insertion module coupled to the loom chassis; and (e) between said forming (c) and said inserting (d), loading a plurality of warp threads into other modular warp units.

36. A modular warp unit for use in a modular weaving machine, the warp unit comprising:

a body configured for being received within a loom chassis;

said body configured for supporting a plurality of removable bobbins;

said bobbins configured for being pre-loaded with a plurality of warp threads;

said body configured to support said warp threads in parallel, spaced relation to one another, extending from said bobbins in a downstream direction; and a plurality of heddles engagable by a plurality of shedding actuators coupled to said loom chassis, to form a shed with said warp threads through which a weft insertion module associated with the loom chassis is configured to insert a weft thread.

37. The warp unit of claim 36, wherein said heddles comprise quick-release heddles releasably supported by said body, each of said quick-release heddles configured for respectively receiving at least one of said warp threads therein.

38. The warp unit of claim 36, comprising a modular reed releasably supported by said body, said modular reed including a plurality of detachable blades configured for being interspersed among said warp threads, said modular reed assembly configured for being engaged by an actuating sley disposed on the loom chassis.

* * * * *